United States Patent [19]

Isono et al.

[11] 4,088,483

[45] May 9, 1978

[54] ELECTROPHOTOGRAPHIC PLATE WITH CHARGE TRANSPORT OVERLAYER

[75] Inventors: Yoshihiro Isono, Itami; Masataka Oda, Toyonaka, both of Japan

[73] Assignee: Minolta Camera Kabushiki Kaisha, Japan

[21] Appl. No.: 547,086

[22] Filed: Feb. 4, 1975

[30] Foreign Application Priority Data

Feb. 13, 1974 Japan ..... 49-17419

[51] Int. Cl.[2] ..... G03Q 5/082

[52] U.S. Cl. ..... 96/1.5 R

[58] Field of Search ..... 96/1 R, 1.5, 1.6; 252/501

[56] References Cited

U.S. PATENT DOCUMENTS

| | | | |
|---|---|---|---|
| 2,803,542 | 8/1957 | Ullrich | 96/1.5 |
| 3,287,116 | 11/1966 | Hoegl | 96/1.5 |
| 3,573,906 | 4/1971 | Goffe | 96/1.5 |
| 3,725,058 | 4/1973 | Hayashi et al. | 96/1.6 X |
| 3,791,826 | 2/1974 | Cherry et al. | 96/1.5 |
| 3,834,809 | 10/1974 | Yoshizawa et al. | 96/1 R X |
| 3,871,884 | 3/1975 | Matsumoto et al. | 96/1.6 |
| 3,884,691 | 5/1975 | Rochlitz | 96/1.5 X |

*Primary Examiner*—Roland E. Martin, Jr.

*Attorney, Agent, or Firm*—Wenderoth, Lind & Ponack

[57] ABSTRACT

An electrophotographic photosensitive plate which comprises an electrically conductive base, an inorganic photoconductive thin layer of selenium or selenium-arsenic formed on the conductive base, and an organic semiconductor layer, for example, of polyvinylcarbazole further deposited on the inorganic photoconductive layer. By the addition of a proper amount of nitrated benzoic acid derivatives to the upper organic semiconductor layer, the increase of residual potential and difficulty of maintaining surface potential in repeated use of the photosensitive plate are remarkably reduced.

6 Claims, 12 Drawing Figures

SPECTRAL SENSITIVITY

ELECTROPHOTOGRAPHIC PLATE WITH CHARGE TRANSPORT OVERLAYER

Figure 1:
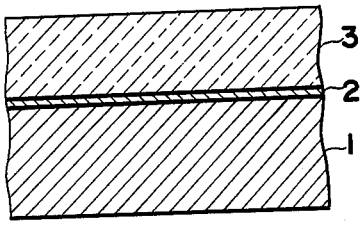

This invention relates to an electrophotographic photosensitive plate, and more particularly to an improved photosensitive plate for use in an electrophotographic copying machine which is composed of an electrically conductive base, a photoconductive thin layer deposited on the electrically conductive layer for generating charge carriers by absorbing visible light rays, and an organic photoconductive semiconductor layer further deposited on the photoconductive thin layer, for retaining charges and for transporting the generated photoelectric charge carriers.

The dual layered photosensitive member as described above was first disclosed in Japanese Patent Publication No. 43-16198 as an electrophotographic film because of its applicability to an electrophotographic photosensitive plate, and especially because of its superiority in light transparency and flexible characteristics. Subsequently, in Japanese Patent Publication No. 45-5349, it was disclosed that such a dual layered photoconductive member exhibits higher sensitivity if no sensitizer, either chemical or optical, is included in the organic photoconductive semiconductor layer thereof.

The above-mentioned disclosures of the two Japanese Patent Publications are substantially similar to that of U.S. Pat. No. 3,725,058, in which the photosensitive plate is composed of an organic photoconductive insulating material, such as polyvinylcarbazole deposited on a thin layer of selenium with said organic photoconductive insulating layer being substantially non-light sensitive in the visible light range and with the same rendered light sensitive in the visible light range of 400 to 750 mu only when some sensitizer is added thereto. However, since the selenium layer of the above described photosensitive plate is formed immediately below the organic photoconductive insulating top layer with charge carriers generated in the selenium layer when the photosensitive plate is exposed to visible light rays, the function of the organic photoconductive insulating layer is only to provide a path for the charge carriers and to retain charges on the surface of the insulating layer, and consequently no particular sensitizer is added to the insulating layer.

On the other hand, a photosensitive plate wherein the organic photoconductive insulating material is formed into a single layer has already been proposed in U.S. Pat. No. 3,037,861, in which photosensitive plate, ultraviolet rays are employed when no sensitizers are included in the plate, while visible light rays are employed if some sensitizers are added to the plate for the image formation on the plate.

According to a series of experiments carried out by the present inventors, however, it has been confirmed that these photosensitive members disclosed in the above U.S. Patents, either have the residual potential thereof increased or make it difficult to maintain sufficient surface potential thereon after repeated use, thus being unable to be reused for a long period of time.

In order to overcome such defects, a photosensitive member wherein isocyanate compounds are added to the organic photoconductive insulating layer for improvement has been proposed. This photosensitive member, is reusable for a long period of time to a certain extent under normal temperatures and humidity, as confirmed in experiments by the present inventors.

Nevertheless, it is poorly suited for repeated use over a long period of time under high temperature and humidity due to increase of residual potential resulting from the rise of conductivity of the photosensitive member itself when subjected to either high temperatures or high humidity. Accordingly, it has been strongly desired to introduce a photosensitive member which will sufficiently endure such high temperatures and humidity, since photosensitive members to be incorporated in electrophotographic copying machines inevitably undergo high temperatures and humidity arising from exposure light sources, heat sources for fixing and the circumstances under which these copying machines are used. Additionally, it is desirable that a photosensitive plate which will fully meet the practical use should have good heat-resistance as well as high photosensitivity. Among substances not only excellent in heat-resistance but also superior a sensitizer is arsenic (As) which is referred to in U.S. Pat. No. 2,803,542. In the photosensitive member disclosed in the above U.S. Patent, however, it is necessary to form the selenium layer in a thickness of several tens of microns so as to permit the selenium layer itself to function as a photoreceptor, i.e., to perform the functions of holding charges on the surface thereof besides the function of generating charge carriers, in which the addition of a large amount of arsenic in the selenium layer for the above purpose causes an increase in conductivity, thus expediting the dark decay rate and making it undesirable for the photosensitive member to be adopted for the practical purpose. Accordingly, the amount of arsenic to be added is inevitably limited and and sensitization of the photosensitive member beyond a certain level can not be expected.

Accordingly, an essential object of the present invention is to provide an electrophotographic photosensitive plate having superior repetitive characteristics with substantial elimination of the disadvantages inherent in the conventional photosensitive plates.

Another important object of the present invention is to provide an electrophotographic photosensitive plate having superior repetitive characteristics even under the conditions of high temperatures and high humidity.

A further object of the present invention is to provide an electrophotographic photosensitive plate with high sensitivity.

A still further object of the present invention is to provide an electrophotographic photosensitive plate with long life which is flexible, reusable, and capable of light transmission, and which is advantageously incorporated in an electrophotographic copying machine.

According to a preferred embodiment of the present invention, the electrophotographic photosensitive plate comprises, in the order from the bottom up, an electrically conductive base, an inorganic photoconductive thin layer of selenium or selenium-arsenic formed on the conductive base, and an organic semiconductor layer, of for example, polyvinylcarbazole further deposited on the inorganic photoconductive layer for the purpose of forming an electrostatic latent image thereon.

In the above described dual layered photosensitive plate of the invention, approximately 0.2 to 2.0 parts by weight of nitrated compund of benzoic acid derivative is added to the upper organic semiconductive layer, by which addition, increase of residual potential and difficulty for maintaining surface potential in the repeated use of the photosensitive plate are remarkably reduced with sufficient durability of the plate even under the conditions of high temperatures and high humidity.

Furthermore, in the above photosensitive plate of the invention, it is possible to include arsenic having superior heat-resistance and sensitization characteristics in the intermediate inorganic photoconductive layer to a level of approximately 40% by weight, which amount of arsenic inclusion has hitherto been considered extremely difficult.

Figure 2:
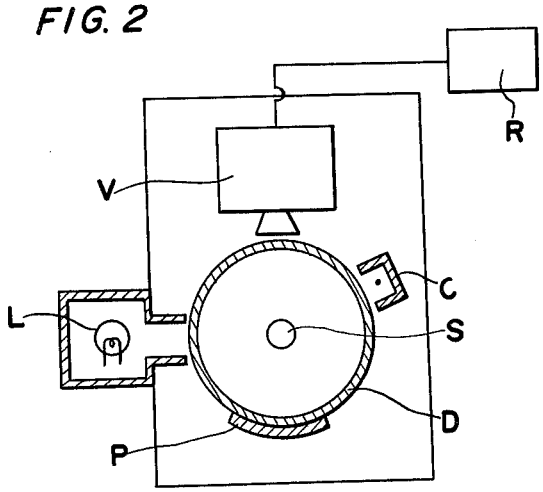
Figure 7:
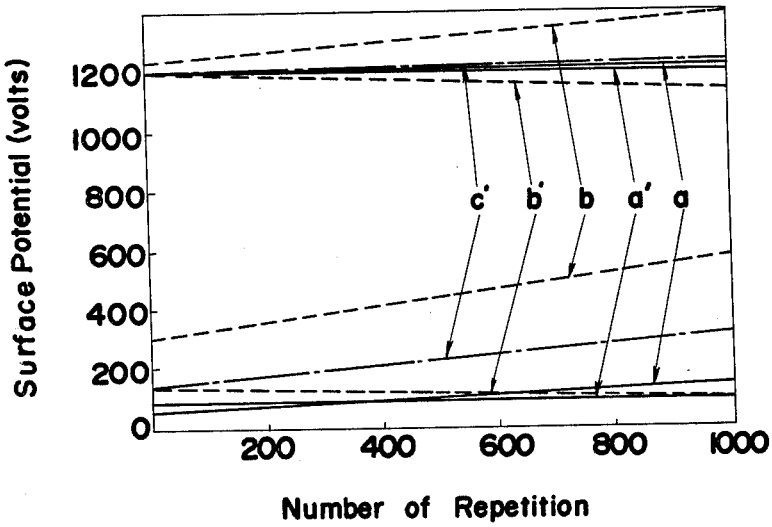
Figure 8:
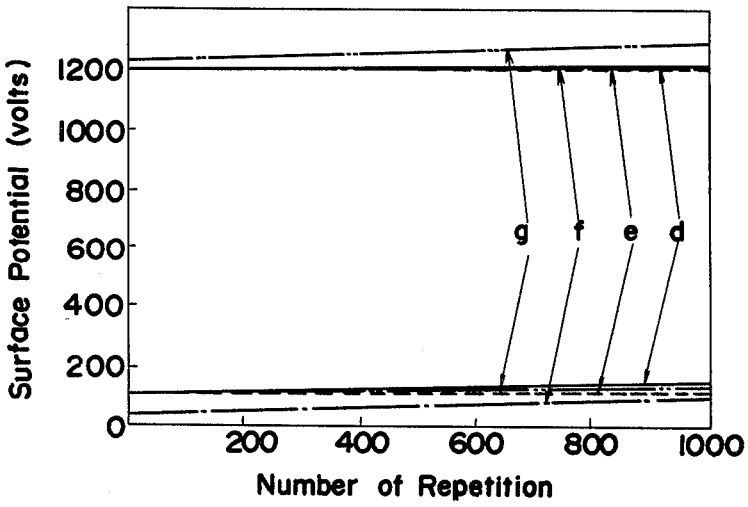
Figure 9:
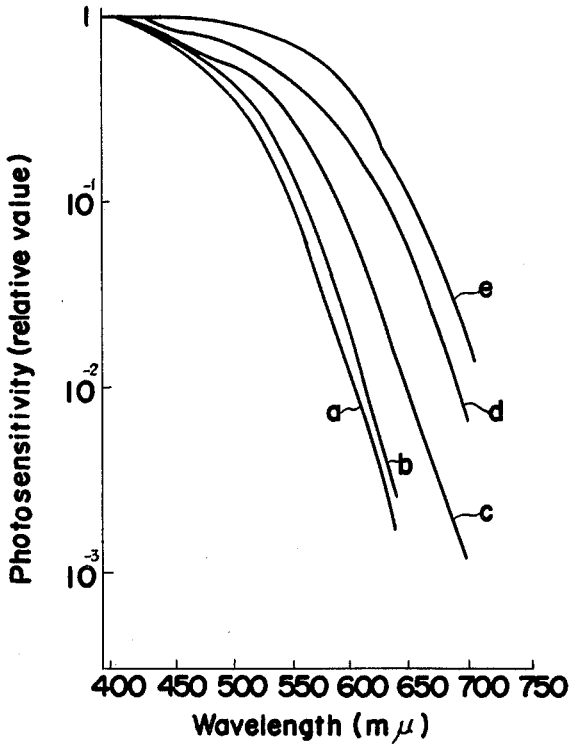
Figure 10:
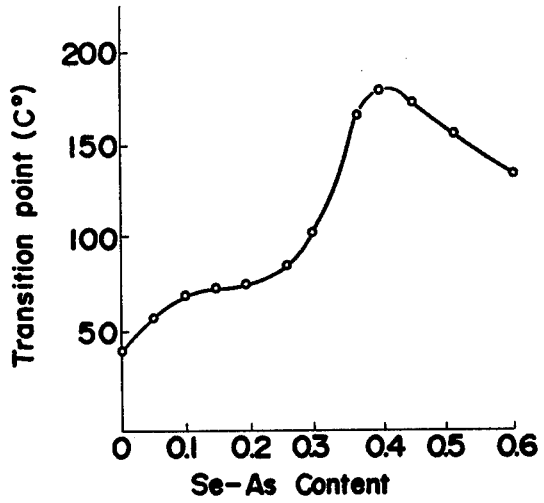
Figure 11:
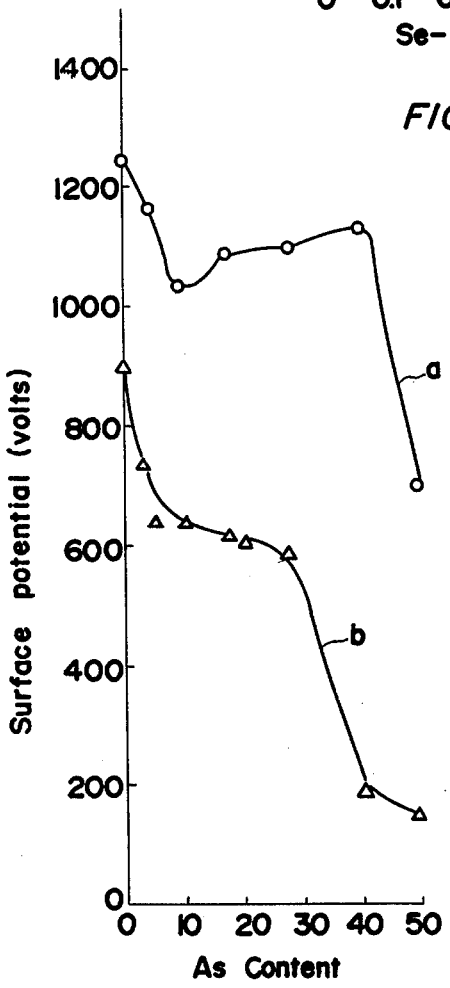
Figure 12:
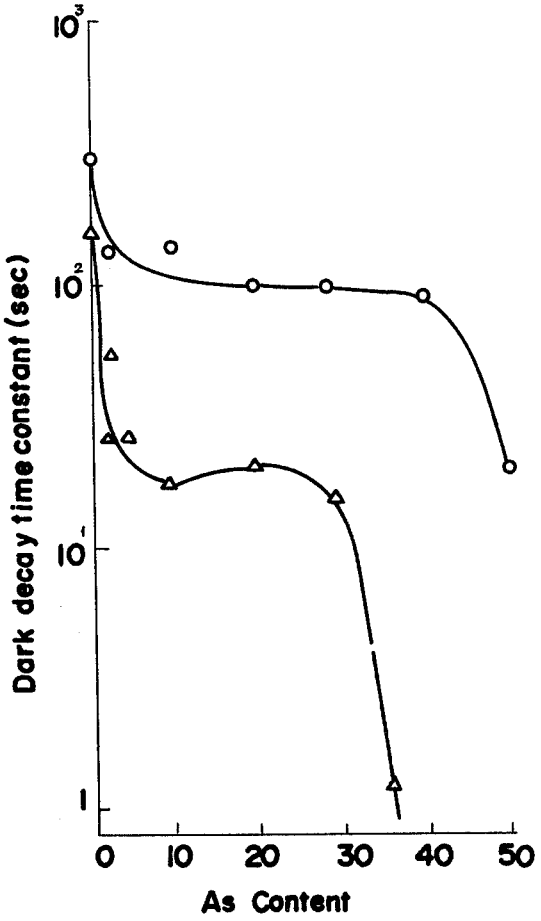

These and other objects and features of the present invention will become apparent from the following description taken in conjunction with the preferred embodiment thereof with reference to the accompanying drawings, in which;

FIG. 1 is a cross sectional view showing structure of an electrophotographic photosensitive plate of the invention, FIG. 2 is a schematic top plan view of a testing device for electrophotographic photosensitive plates, FIGS. 3 to 8 are graphs showing repetitive characteristics of photosensitive plates as measured by the device in FIG. 2 wherein the ratio of nitrated compounds of benzoic acid derivatives to polyvinylcarbazole in organic semiconductive layer thereof is varied to determine the optimum amount of the former to the latter, FIG. 9 is a graph showing spectral sensitivity of photosensitive plate included therein with various amount of arsenic, FIG. 10 is a graph showing heat resistant characteristics of a photosensitive plate included with arsenic, FIG. 11 is a graph showing surface potential characteristics of a photosensitive plate included with arsenic, and FIG. 12 is a graph showing dark decay characteristics of a photosensitive plate included with arsenic.

Before the description of the present invention proceeds, it is to be noted that like parts and curves are designated by like numerals throughout the accompanying drawings.

Referring to FIG. 1, there is shown an electrophotographic photosensitive plate P of the invention which comprises an organic photoconductive semiconductor layer 3 of polyvinylcarbazole or the like applied onto a known electrically conductive flexible base 1 with a photoconductive thin interlayer 2 of amorphous selenium or selenium alloy therebetween. The electrically conductive flexible base 1 is composed, for example, of a metallic layer of aluminum or the like deposited on, or of a coating of electrically conductive solvent applied onto, a metallic substrate of iron, aluminum, copper etc., or a substrate of polyester film, paper or the like. The photoconductive interlayer 2 of selenium acts as charge carriers by absorbing visible light rays, while the organic semiconductive layer 3 serves to retain the charges therein and also functions as a path for the charge carriers of visible light rays formed in the selenium layer. In the electrophotographic photosensitive plate P of the above construction, the selenium layer 2 having the photoconductive function is deposited over the flexible base 1 to the thickness of approximately 0.1 to 1.0 micron and contains therein 10 to 40% arsenic for improving heat-resistance and sensitivity, while the polyvinylcarbazole layer 3 is applied onto the selenium layer 2 to the ultimate thickness of 5 to 30 microns and contains approximately 0.2 to 2.0 parts by weight of nitrated compounds of benzoic acid derivatives for improved repetitive characteristics of the photosensitive plate under high temperatures and humidity. More specifically, such compounds may be represented by the following chemical formula:

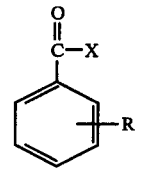

wherein, X is OH or Cl, and R is a plurality of nitro radicals the nucleus being the benzene ring. In other words, benzoic acid or benzoyl chloride di or trinitro compounds are effective for inclusion in the polyvinylcarbazole layer 3, among which additives, many compounds are considered to be suitable, for example, 3,5-dinitro-benzoic acid represented by the formula:

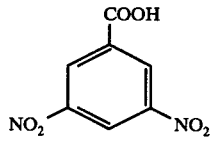

2,4-dinitro-benzoic acid represented by:

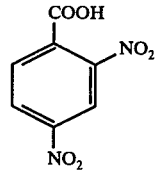

2,4,6-trinitro-benzoic acid shown by the formula:

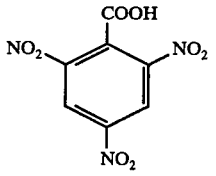

3,5-dinitro-benzoyl chloride represented by:

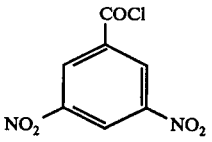

and other combinations of such compounds or compounds thereof with more than four nitro radicals. In any of these compounds, proper ratio of addition should be approximately 0.2 to 2.0 parts by weight to 100 parts by weight of polyvinylcarbazole, and preferably be 0.2 to 1.0 parts by weight.

According to the present invention, it has been confirmed by the following experiments with the use of a testing device T as shown in FIG. 2 that the dual layered photosensitive plate P containing the nitrated compounds of benzoic acid derivatives in the organic photoconductive semiconductor layer 3 exhibits favorable repetitive characteristics even under high temperatures and humidity as well as under normal temperatures and humidity.

Referring to FIG. 2, the testing device T comprises a drum D rotatably mounted on a shaft S for supporting the photosensitive plate P to be tested on the outer periphery thereof with a corona charger C, a surface potentiometer V and a light source L sequentially disposed around the drum D so that the potential measured by the potentiometer V is shown by a recorder R. Using the above described testing device T, measurements were repeatedly taken at an elevated temperature of 50° C under the following testing conditions with the test plate P mounted on the drum D.

Voltage applied by the corona charge C : 6KV
Amount of exposure : 100 lux. sec.
Rotational speed of the drum D : 33 r.p.m.
Light source : tungsten lamp.

The results of the above test are shown in the graphs of FIGS. 3 to 6, in which graphs, curves marked ○ relate to the photosensitive plates not containing any of the above described compounds while curves marked Δ relate to the photosensitive plates containing the above described specific compounds at the ratio of 0.2 parts to 100 parts by weight of polyvinylcarbazole in the polyvinylcarbazole layer 3. Other curves marked X, □, ●, ▲, ◑ and ■ relate to photosensitive plates containing the above described compound at the ratio of 0.5, 1.0, 2.0 3.0, 5.0 and 6.0 parts respectively to 100 parts by weight of polyvinylcarbazole in the polyvinylcarbazole layer 3.

The present invention will be described hereinbelow with reference to examples of preferred embodiments.

EXAMPLE 1

A Se-As alloy containing 28.6 atomic % of arsenic is deposited, to the thickness of about 0.5μ, over an electrically conductive base composed of a polyester film of 100μ thickness having a thin layer of aluminum deposited thereon, and an organic photoconductive semiconductor in the form of a liquid having the following composition is applied onto said Se-As alloy layer to form a film layer of 18μ thickness when dried, a dual layered electrophotographic photosensitive plate thus being prepared.

| Composition | Parts by weight |
|---|---|
| poly-N-vinylcarbazole | 100 |
| polycarbonate | 30 |
| ortho-terphenyl | 50 |
| chlorinated paraffin | 10 |
| monochlorobenzene | 900 |

Although the above described photosensitive plate does not contain any nitrated compounds of benzoic acid, photosensitive plates containing 0.2, 0.5, 1.0, 2.0, 3.0, 5.0 and 6.0 parts of 3.5-dinitro-benzoic acid in the above composition, and those containing 2,4-dinitro-benzoic acid, 2,4,6-trinitro-benzoic acid or 3,5-dinitro-benzoyl chloride at the ratio of 0.2, 0.5, 1.0, 2.0, 3.0 and 5.0 parts respectively were prepared, the number of photosensitive plates thus prepared amounting to 26 kinds in total.

With the above described test materials, the photosensitive plates containing, in its polyvnylcarbazole layer, 0 to 6.0 parts by weight of the compounds to 100 parts by weight of polyvinylcarbazole were first tested for the repetitive characteristics thereof with the following findings.

Figure 3:
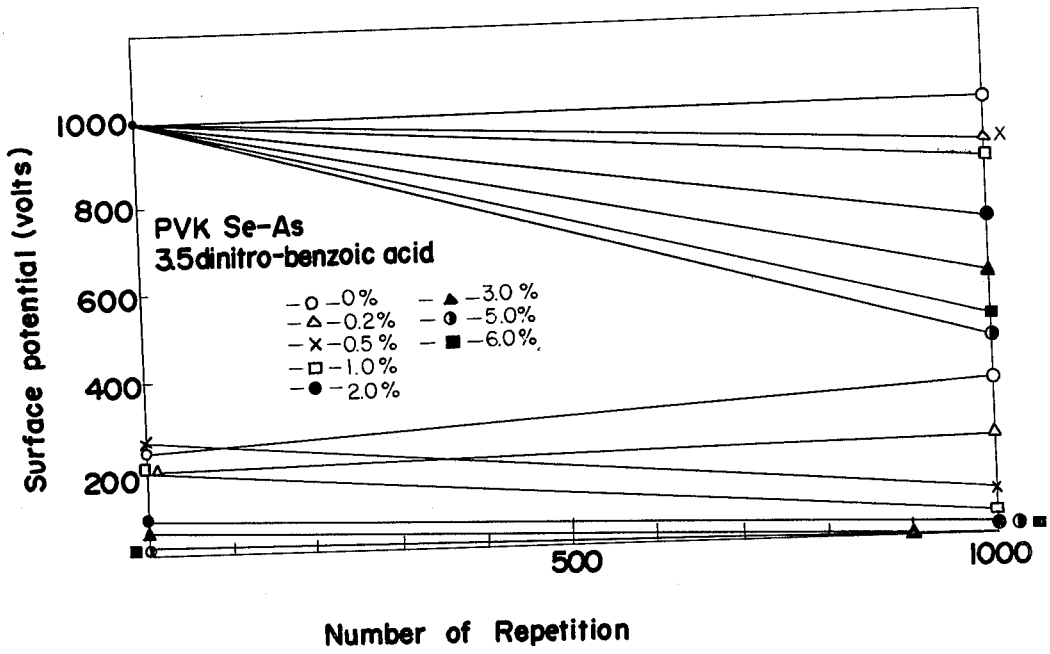

Referring to FIG. 3, in the photosensitive plate wherein no compounds were contained, it was found that the residual potential thereof increased to such an extent as to render the photosensitive plate unsuitable for practical purpose after repeated use of only about 1000 times, although decrease of the surface potential was hardly noticed. On the contrary, when more than 2 parts by weight of the above compounds are contained in the photosensitive plate, decrease of the surface potential, i.e., difficulty for retaining the charge impressed on the surface of the polyvinylcarbazole layer was noticed, although the increase of the residual potential could be suppressed.

Figure 4:
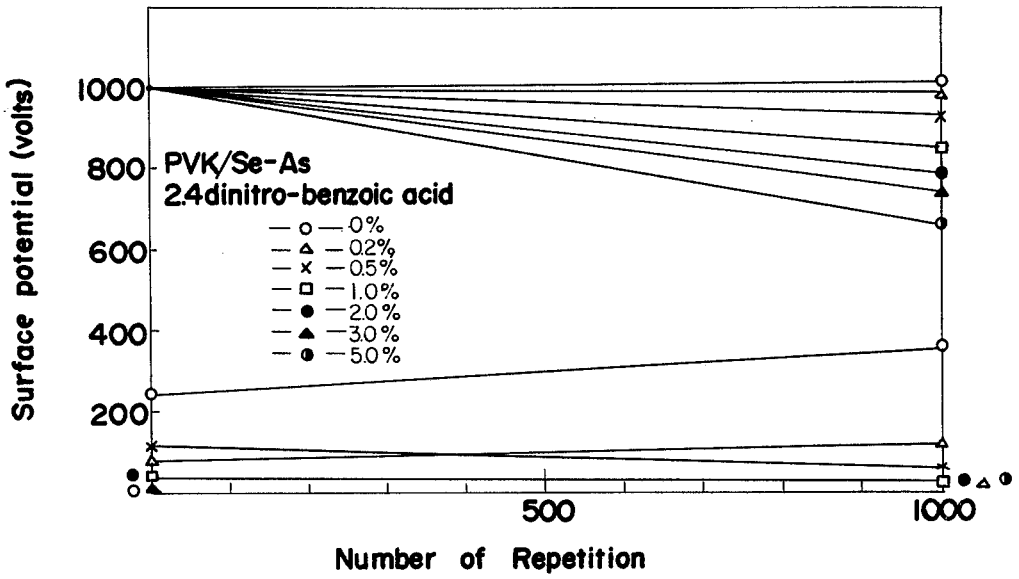
Figure 5:
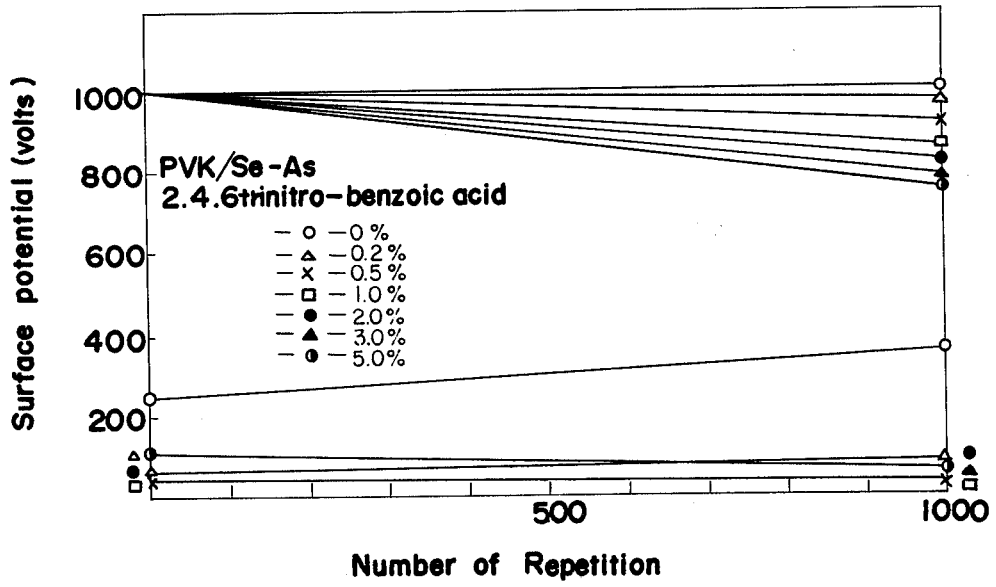
Figure 6:
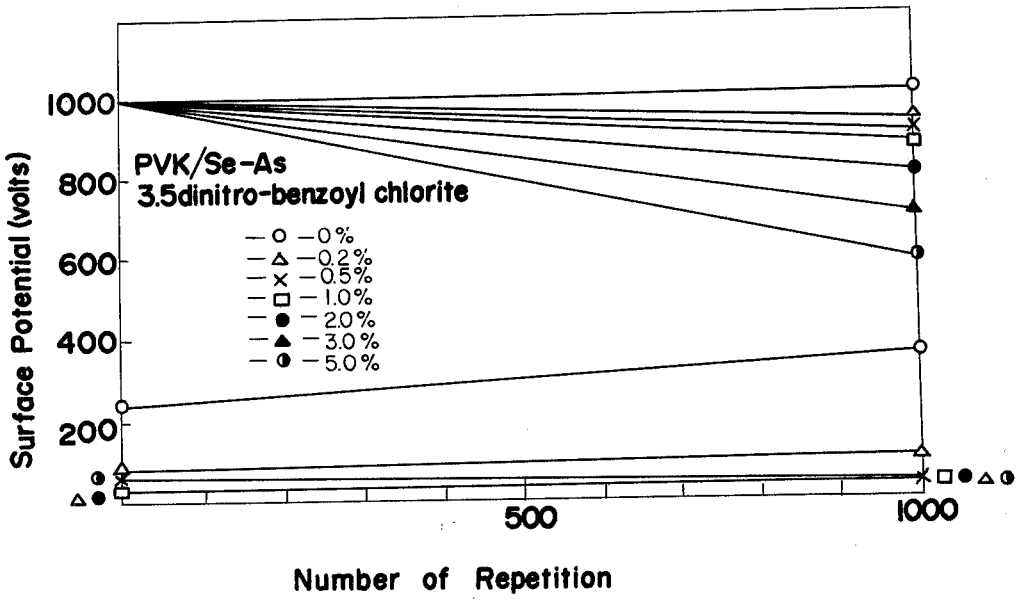

Referring to FIGS. 4 to 6, there is shown the replicate characteristics of photosensitive plates containing 0 to 5.0 parts by weight of 2,4-dinitro-benzoic acid, 2,4,6-trinitro-benzoic acid and 3,5-dinitro-benzoyl chloride. From the curves in these Figures, it is noticed that the above photosensitive plates show results much the same as those in FIG. 3.

For an electrophotographic photosensitive plate be fully practical, it is desired that the difference between the surface potential and the residual potential alwyas be above a predetermined level, which potential difference should preferably be approximately more than 600 volts when the photosensitive plate is incorporated into a copying machine of powder image transfer type, and approximately more than 800 volts for a copying machine of electrostatic latent image transfer type. From this fact, taking into account the results obtained in FIGS. 3 to 6, the content of the nitrated compounds of benzoic acid derivatives to be contained in the polyvinylcabazole layer should statistically be approximately 0.2 to 2.0 parts by weight, and preferably be approximately 0.2 to 1.0 parts by weight. Although, in the photosensitive plates in FIGS. 3 to 6, the maximum surface potential was set to be 1000 volts, it is possible to increase the potential up to 1500 volts actually, from which fact it can be concluded that photosensitive plates meeting the earlier mentioned requirements even after repeated use of several thousand times are those containing compounds in the above-described range. Accordingly, the present inventors confirmed through experiments that, in the dual layered photosensitive plates of the invention wherein the nitrated compounds of benzonic acid derivatives of 0.2 to 2.0 parts by weight are contained, the increase of the residual potential and the decrease of the surface potential were effectively suppressed.

Referring now to FIGS. 7 and 8, there are shown results of repeated measurement taken in the experiments carried out to prove that the photosensitive plate of the invention is superior to conventional plates even under high temperatures and high humidity. In this experiment, the photosensitive plate which had been kept in a tank maintained at constant temperature and humidity of 40° C and 90% for 20 days was attached to the testing device shown in FIG. 2 and tested under an elevated temperature of 50° C with the temperature and humidity maintained at normal level of 20° C and 60% for comparison.

EXAMPLE 2

An amorphous selenium was deposited, to the thickness of approximately 1μ, over an electrically conductive base composed of a polyester film of 100μ thick having a thin layer of aluminum deposited thereon, and an organic photoconductive semiconductor in the form of a liquid having the following composition was applied onto the amorphous selenium layer to form a film layer of 20μ thick when dried, thus a dual layered electrophotographic photosensitive plate being prepared.

| Composition | Parts by weight |
|---|---|
| poly-N-vinylcarbazole | 100 |
| polycarbonate | 30 |
| chlorinated paraffin | 20 |
| 3,5-dinitro-benzoic acid | 1 |
| monochlorobenzene | 900 |

In the above EXAMPLE 2, the composition of the organic photoconductive semiconductor liquid is different from that in the EXAMPLE 1 in that the ortho-terphenyl contained in the latter is not contained in the former, however, it has been confirmed that the absence of the orthoterphenyl does not substantially affect the image forming function of the polyvinylcarbazole layer.

In FIG. 7, the curve a shows the repetitive characteristics of the photosensitive plate in EXAMPLE 2 measured under the earlier mentioned condition of high temperatures and high humidity, while the curve *a'* shows the replicate characteristics of the same photosensitive plate as in the EXAMPLE 2 measured under normal temperature and humidity of 20° C and 60%. Furthermore, for comparison, curves *b* and *b'* are plotted to show the repetitive characteristics of photosensitive plates under high temperatures and high humidity, and also under normal temperatures and humidity respectively, in which photosensitive plates represented by the curves *b* and *b'*, 3 parts of Mirionate MR (manufactured by Nippon Urethane Co.) as an isocyanate compound are added instead of the 1 part of 3,5-dinitrobenzonic acid contained in the photosensitive plate of the EXAMPLE 2, while the curve *c'* is plotted to show the replicate characteristics of a photosensitive plate measured under the normal temperatures and normal humidity with the 3,5-dinitro-benzoic acid of the photosensitive plate in the EXAMPLE 2 dispensed with.

As is clear from the above described characteristics curves, photosensitive plates containing the 3,5-dinitrobenzoic aid, although rather higher in increasing the rate of the residual potential at high temperature and humidity than at the normal temperature and humidity, has a very low residual potential of 150 volts at the 1000th measurement as compared with the initial surface potential of 1200 volts, thus showing excellent repetitive characteristics. On the contrary, the photosensitive plates containing above mentioned Mirionate MR, although good in replicate characteristics under normal temperatures and humidity, were extremely inferior, showing a remarkably increased residual potential of 300 volts from the first measurement, while those plates without containing Mirionate MR have the residual potential thereof increased at an extreme rate even under normal temperatures and humidity with the residual potential at the 1000th measurement increasing twice as much up to 300 volts.

EXAMPLE 3

A photosensitive plate which is quite similar to the plate in the EXAMPLE 2 except for the ratio of 3,5-dinitro-benzoic acid reduced down to 0.5 parts by weight was prepared for repetitive measurements under high temperatures and humidity, the result of which is shown by the curve *d* in FIG. 8.

EXAMPLE 4

A photosensitive plate which is quite similar to the plate in the EXAMPLE 2 except for the ratio of 3,5-dinitro-benzoic acid increased up to 2 parts by weight was prepared for repetitive measurements under high temperatures and humidity, the result of which is shown by the curve *e* in FIG. 8.

EXAMPLE 5

A photosensitive plate which is quite similar to the plate in the EXAMPLE 2 except for 2 parts by weight of 2,4,6-trinitro-benzoic acid employed instead of 3,5-dinitrobenzoic acid was prepared for repetitive measurements under high temperatures and humidity, with the result as shown by the curve *f* in FIG. 8.

EXAMPLE 6

An Se-As alloy containing arsenic of 28.6 atomic % was deposited, to the thickness of approximately 1μ, over an electrically conductve base composed of a polyester film of 100μ thick with a thin layer of aluminum deposited thereon, and an organic photoconductive semiconductor in the form of a liquid having the same composition as that in the EXAMPLE 2 was applied onto the Se-As alloy layer to form a film layer of 15μ thick when dried, thus a dual layered electrophotographic photosensitive plate was prepared for replicate measurements under high temperatures and humidity, the result of which is shown by the curve *g* in FIG. 8.

As is clear from the foregoing EXAMPLES, the dual layered electrophotograhic photosensitive plate of the invention containing 0.2 to 2.0 parts by weight of dinitro compounds of benzoic acid derivatives to 100 parts by weight of polyvinylcarbazole, and having remarkably excellent repetitive characteristics even under the conditions of high temperatures and humidity can be repreatedly used for a long period of time when employed in copying machines of transfer type.

Referring to FIGS. 9 to 12, there is shown the replicate characteristics of photosensitive plates representing a second feature of the invention wherein approximately 10 to 40% of arsenic is added to the selenium layer.

Conventionally, it is disclosed in U.S. Pat. Nos. 2,803,542 and 2,822,300 that addition of a predetermined amount of arsenic to selenium results in improvement of heat-resistance and spectral sensitivity of xerographic plates, which xerographic plates, however, are limited in the content of arsenic, since it is essential that the selenium layer thereof be several tens of microns in thickness and that the selenium layer be charged at its surface. Although it is disclosed in the U.S. Pat. No. 2,822,300 that addition of arsenic up to 50% is possible, the present inventors confirmed through experiments that inclusion of approximately more than 20% of arsenic into a single selenium layer is not suitable for practical use, which fact is mentioned in more detail later. It is considered theoretically that inclusion of a large amount of arsenic into the selenium layer results in the increase of electrical conductivity and the trapping of charges in the selenium layer, thus making the photosensitive plate unsuitable for actual use. In other words, the rise of electrical conductivity in the selenium layer makes it difficult for the selenium layer itself to hold the charges at the surface thereof, and besides, since arsenic itself is a kind of impurity, the trapping rate of holes to electrons formed in the selenium layer by the exposure is increased with gradual rise of the residual potential.

On the contrary, in the photosensitive plate of the invention, since the functions of holding the charges and generation of charge carriers are shared by the polyvinylcarbazole layer 3 and the selenium layer 2 respectively (FIG. 1) with the selenium layer 2 being a thin layer less than 1μ in thickness, the mixing percent of arsenic in the selenium layer may be in the range from 10 to 40%, preferably 20 to 40%, thus offering a photosensitive plate which can be put into practical use without any inconvenience.

Still referring to FIGS. 9 to 12, the general spectral sensitivity of a photosensitive plate wherein arsenic is added to the selenium layer is shown in FIG. 9, in which FIG. 9, the curve a represents spectral sensitivity when 3% of arsenic was contained in the selenium layer, while curves *b, c, d* and *e* show spectral sensitivity with arsenic contents of 10%, 20%, 28.6% and 40% in the selenium layer respectively.

It is self-explanatory from FIG. 9 that the more amount of arsenic is contained in the selenium layer, the higher does the spectral sensitivity rise and that inclusion of a large quantity of arsenic in the selenium layer is desirable from the viewpoint of practical use.

In FIG. 10, there is shown heat characteristics of a photosensitive plate wherein arsenic is included in the selenium layer in order to prevent crystallization of the selenium. Although amorphous selenium is rendered vitreous at temperatures around or more than 50° to 80° C, the vitrification is gradual, so that by adding substances with good heat-resistance to the selenium layer, the gradual change of state toward vitrification can considerably be suppressed. As is seen from FIG. 10, the transition point in degrees centigrade is increased at the arsenic content of 20% or more, reaching the maximum degrees of approximately 180° C at the arsenic content of 40%. On the contrary, in the region with arsenic content of more than 40%, the transition point tends to fall, proving that inclusion of arsenic more than this 40% level affects adversely to the prevention of crystallization of the selenium.

In FIG. 11, the surface potential characteristics of the photosensitive plate of the invention is shown by a curve *a*, while that of a plate having a single Se-As layer is represented by a curve *b*, in which, experiments were carried out under the condition that, in the curve *a*, the thickness of the polyvinylcarbazole layer 3 was 18μ with that of Se-As layer 2 being 0.3μ, whereas, in the curve *b*, the thickness of the single Se-As layer was 30μ. From FIG. 11, it is clear that, in the Se-As single layer shown by the curve *b*, the surface potential decreases with the increase of the As content, rendering the photosensitive plate unsuitable for practical use at or more than approximately 20% of arsenic content. On the contrary, in the photosensitive plate of the invention represented by the curve *a*, the content of arsenic can advantageously be increased up to approximately 40% without any inconvenience in practical use.

In FIG. 12, comparision of dark decay characteristics of the photosensitive plates in FIG. 11 is given, in which the curve *a* represents the characteristics of the photosensitive plate of the invention, while the curve *b* is that of the plate having Se-As single layer. As is noticed from FIG. 12, in the photosensitive plate of the invention represented by the curve *a*, arsenic content up to 40% therein exhibits superior dark decay characteristics, while, in the plate with single Se-As layer shown by the curve *b*, the decay ratio abruptly rises at the arsenic content of 20% or more.

As is clear from the foregoing description, the electrophotographic photosensitive plate of the invention contains approximately 0.2 to 2.0 parts by weight of nitrated compounds of benzoic acid derivatives in the polyvinylcarbazole layer 3 forming the upper organic semiconductor layer of the photosensitive plate, so that excellent repetitive characteristics of the photosensitive plate can be expected even under the condition of high temperatures and high humidity. Furthermore, since arsenic up to approximately 40% can be included in the intermediate Se-As layer 2, it is possible to achieve marked improvement of sensitivity not available in the conventional photosensitive plates and also effective prevention of the crystallization of selenium in the Se layer, thus photosensitive plates superior in performance under conditions of practical use are advantageously realized.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. An electrophotographic sensitive member for forming an electrostatic latent image which comprises in the following order:

(a) an electrically conductive base, (b) a photoconductive layer including at least selenium disposed on said base and having a thickness in the range of about 0.1 to 1 micron, said layer generating charge carriers therein upon absorption of visible light, (c) an organic semiconductive layer of polyvinylcarbazole having a thickness in the range of about 5 to 30 microns, disposed over said photoconductive layer for retaining charges on the surface thereof and for transporting the charge carriers generated in said photoconductive layer, said organic semiconductive layer containing therein about 0.2 to 2 parts by weight of a nitrated benzoic acid derivative per 100 parts by weight of polyvinylcarbazole said derivative improving the repetitive characteristic of said sensitive member and having the following formula:

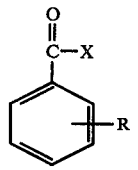

wherein X = OH or Cl and R represents 2 or 3 nitro radicals.

2. An electrophotographic sensitive member as claimed in claim 1, wherein said nitrated benzoic acid derivative is selected from the group consisting of 3,5-dinitrobenzoic acid, 2,4-dinitrobenzoic acid, 2,4,6-trinitrobenzoic acid and 3,5-dinitrobenzoyl chloride.

3. An electrophotographic sensitive member as claimed in claim 1, wherein the amount of said nitrated benzoic acid derivative is about 0.2 to 1 parts by weight.

4. An electrophotographic sensitive member as claimed in claim 1, wherein said photoconductive layer further includes about 10 to 40% by weight of arsenic, with the remainder being said selenium.

5. An electrophotographic sensitive member as claimed in claim 2, wherein said photoconductive layer further includes about 10 to 40% by weight of arsenic with the remainder being said selenium.

6. An electrophotographic sensitive member for forming an electrostatic latent image which comprises in the following order:

(a) an electrically conductive base, (b) a photoconductive layer including at least selenium disposed on said base and having a thickness in the range of about 0.1 to 1 micron, said layer generating charge carriers therein upon absorption of visible light, (c) an organic semiconductive layer of polyvinylcarbazole having a thickness in the range of about 5 to 30 microns, disposed over said photoconductive layer for retaining charges on the surface thereof and for transporting the charge carriers generated in said photoconductive layer, said organic semiconductive layer containing therein about 0.2 to 2 parts by weight of a nitrated benzoic acid derivative per 100 parts by weight of polyvinylcarbazole said derivative improving the repetitive characteristics of said sensitive member and being selected from the group consisting of 3,5-dinitrobenzoic acid, 2,4-dinitrobenzoic acid, 2,4,6-trinitrobenzoic acid and 3,5-dinitrobenzoyl chloride and wherein said photoconductive layer further includes about 10 to 40% by weight of arsenic, with the remainder being selenium.

* * * * *